US006385990B1

(12) United States Patent
Lee

(10) Patent No.: US 6,385,990 B1
(45) Date of Patent: May 14, 2002

(54) FOOD PREPARATION TABLE WITH OPEN TOP FOOD CONTAINERS

(75) Inventor: Ho-Jin Lee, Seoul (KR)

(73) Assignee: Daewoo Electronics Co., Ltd. (KR)

( * ) Notice: Subject to any disclaimer, the term of this patent is extended or adjusted under 35 U.S.C. 154(b) by 0 days.

(21) Appl. No.: 09/898,362

(22) Filed: Jul. 3, 2001

(30) Foreign Application Priority Data

Apr. 6, 2001 (KR) ..... 2001-18146

(51) Int. Cl.[7] ..... F25D 17/04; F25D 23/12

(52) U.S. Cl. ..... 62/407; 62/258

(58) Field of Search ..... 62/407, 411, 413, 62/419, 404, 258, 256, 440; 165/918, 919

(56) References Cited

U.S. PATENT DOCUMENTS 4,802,340 A * 2/1989 Johnson ..... 62/258 X
5,168,719 A * 12/1992 Branz et al. ..... 62/258
5,282,367 A * 2/1994 Moore et al. ..... 62/256
5,363,672 A * 11/1994 Moore et al. ..... 62/258
6,151,905 A * 11/2000 Smith ..... 62/258

* cited by examiner

*Primary Examiner*—Chen-Wen Jiang
(74) *Attorney, Agent, or Firm*—Anderson Kill & Olick, PC

(57) ABSTRACT

A food preparation table for preparing food and refrigerating foodstuffs includes at least one open top food container for holding foodstuffs, a cooling device for absorbing heat from air, an accelerating device for forcing the air to flow and an air supplying device for making a first portion of the air flow around said at least one open top food container and a second portion of the air stacked above the foodstuffs contained in said at least one said at least one open top food container.

8 Claims, 6 Drawing Sheets

FOOD PREPARATION TABLE WITH OPEN TOP FOOD CONTAINERS

FIELD OF THE INVENTION

The present invention relates to a cooling system for use in a food preparation table having open top food containers; and, more particularly, to a cooling system for use in the food preparation table capable of making temperature of the foodstuffs remain in a preferred temperature range by using cold air to keep foodstuffs refrigerated freshly for a long time.

BACKGROUND OF THE INVENTION

Food preparation tables are generally installed in restaurants and sandwich stores and include more than one open top food containers for holding various refrigerated foodstuffs. The refrigerated foodstuffs include usually various kinds of vegetables, hams, cheeses, etc. In order to keep those stuffs fresh for a long time, the temperature thereof has to be maintained between certain temperatures, e.g., 32° F. and 40° F., a temperature range promulgated by National Sanitation Foundation (NSF).

But, since the foodstuffs in the food containers are usually exposed to the ambient air whose temperature tends to be above the temperature range promulgated by NSF, the ambient air supplies heat to the foodstuffs. Therefore, if the food preparation table does not get rid of the heat supplied to the foodstuffs by the ambient air, the temperature of the foodstuffs reaches rapidly to that of the ambient air.

To remove the heat transferred to the foodstuffs, the food preparation tables has usually adopted two kinds of methods. One is to employ cold wall refrigeration enclosures around the food containers. The other is to blow cold air onto the foodstuffs and the food container so that the cold air can absorb heat from the foodstuffs and form an air curtain above the foodstuffs to thereby prevent heat from being transferred to the foodstuffs from the ambient air.

The first method causes some parts of the foodstuffs to be frozen. So the second method has been widely employed in the food preparation tables. One of such food preparation tables employing the second method is disclosed in U.S. Pat. No. 5,168,719 issued to Branz. In Branz's device, cold air supplied from a cold air supplying passage disposed around the food containers flows above the foodstuffs contained in the food containers and then enters into a food-storage compartment through a re-entry passage disposed opposite to the cold air supplying passage.

However, when the cold air supplied above the foodstuffs enters into the food storage compartment through re-entry passage disposed opposite to the cold air supplying passage, ambient air also enters there. Further, the cold air passing above the foodstuffs contained in the food container absorbs heat from the ambient air as well as the foodstuffs. Accordingly, an apparatus for cooling air, which circulates in the food-preparation table, consumes more electricity than actually needed.

In addition, an apparatus for supplying the cold air consumes large amount of electricity in order to form an air curtain between the foodstuffs and the ambient air by jetting the cold air since the apparatus for supplying the cold air needs to jet the cold air without stopping.

SUMMARY OF THE INVENTION

It is, therefore, an object of the present invention to provide a more efficient food preparation table with open top food containers than conventional ones.

In accordance with one aspect of the invention, there is provided a food preparation table for preparing food and refrigerating foodstuffs including:

at least one open top food container for holding foodstuffs;

a cooling device for absorbing heat from air;

an accelerating device for forcing the air to flow; and an air-supplying device for making a first portion of the air flow around the open top food container and a second portion of the air stacked above the foodstuffs contained in the open top food container.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
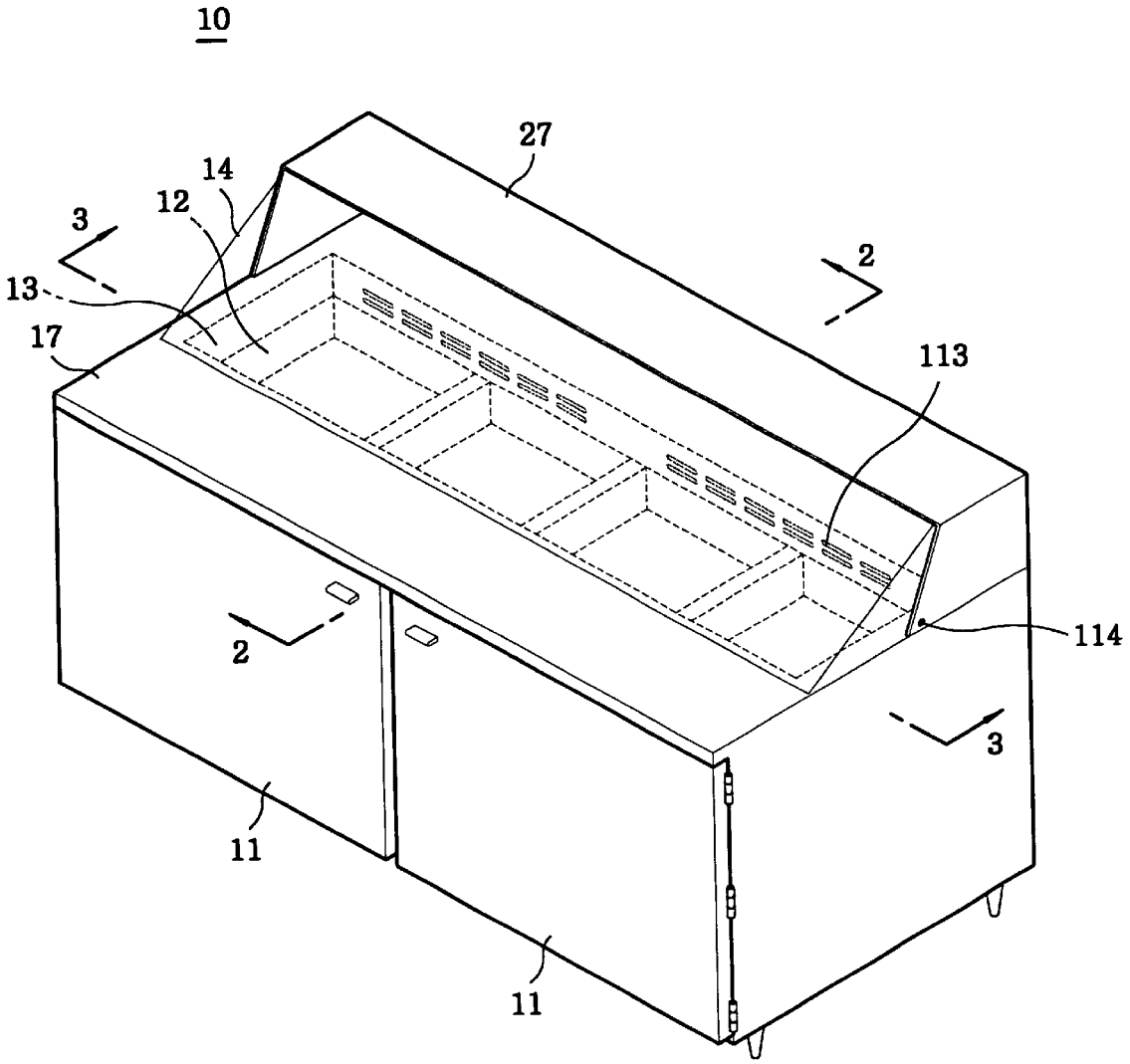
FIG. 1 shows a perspective view of a food preparation table in accordance with a preferred embodiment of the present invention.

Referring to FIG. 1, there is shown a perspective view of a food preparation table in accordance with a preferred embodiment of the present invention. The food preparation table 10 for preparing food and refrigerating foodstuffs includes a pair of doors 11, a counter top 17, a food container support 13 inserted in a hole formed in the counter top 17, four open top food containers 12 rested on a ledge 213 (shown in FIG. 2) of the food container support 13 and a cover 14 rotatably fixed to a cover support 27.

Figure 2:
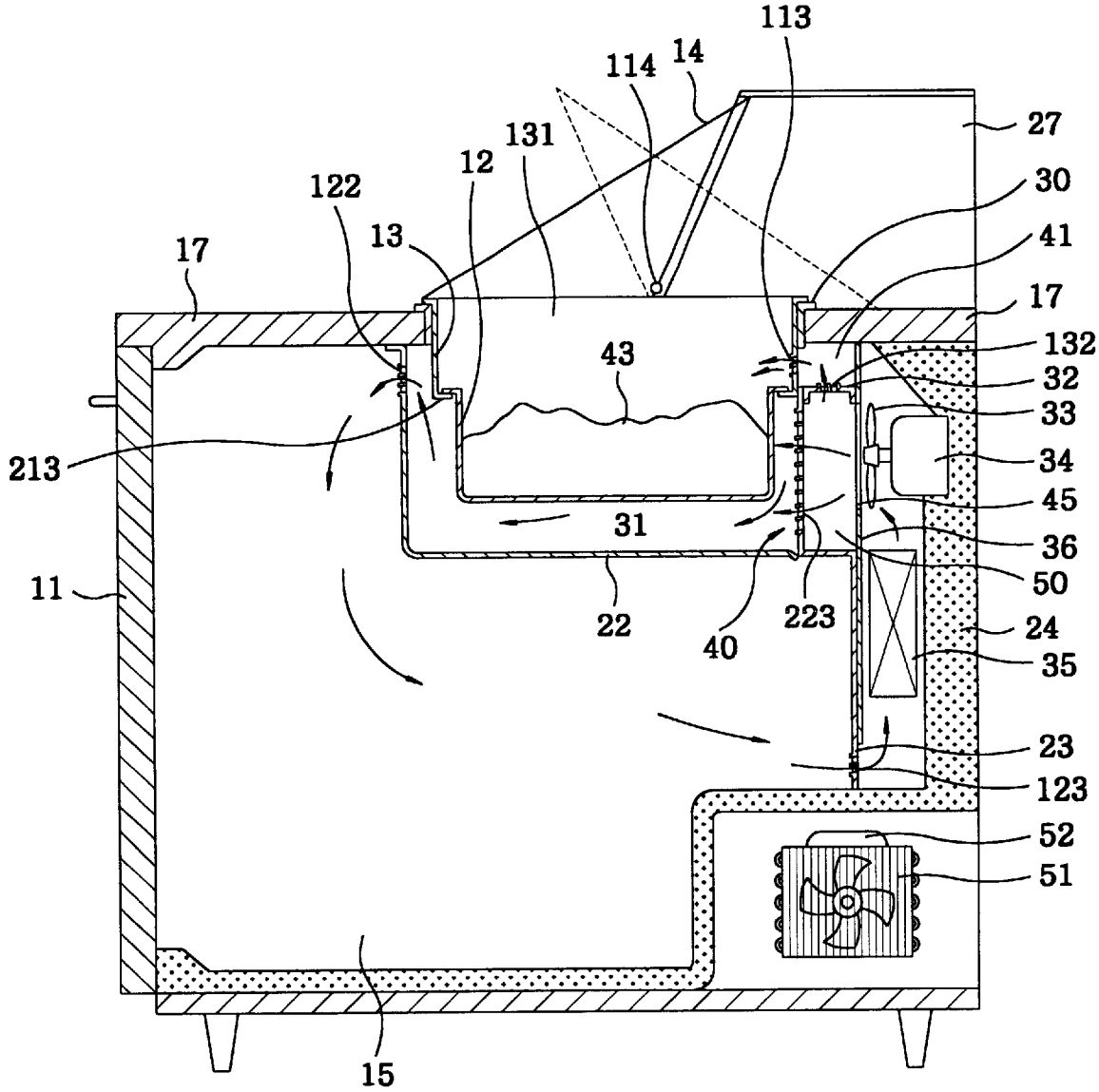
FIG. 2 illustrates a cross sectional view taken along the line 2—2 in FIG. 1.

As shown in FIG. 2, the food preparation table 10 also includes a food storage compartment 15 for rendering foodstuffs refrigerated therein and a cooling system for keeping foodstuffs 43 in the food containers 12 refrigerated freshly for a long time.

The cooling system has an evaporator 35 absorbing heat from circulating air (indicated by arrows) passing across it, a condenser 51, a compressor 52, a pair of fans 33 respectively rotated by motors 34, an air distributing chamber 40 disposed in front of the fans 33, an air room 41 formed above the air distributing member 40 and in contact with the food container support 13, a barrier plenum 131 surrounded by the food container support 13 and disposed above the food containers 12, and a cooling plenum 31 defined by a duct plate 22 and walls of the food containers 12.

The cover 14 rotates about a pair of hinges 114 in the cover support 27 to open or close the barrier plenum 131.

When the cover 14 is closed, the barrier plenum 131 is insulated from ambient air outside the cover 14. Instead of one-piece cover 14, more than one cover can be provided to selectively limit access to the food containers 12. Preferably, the cover 14 can be transparent.

Figure 3:
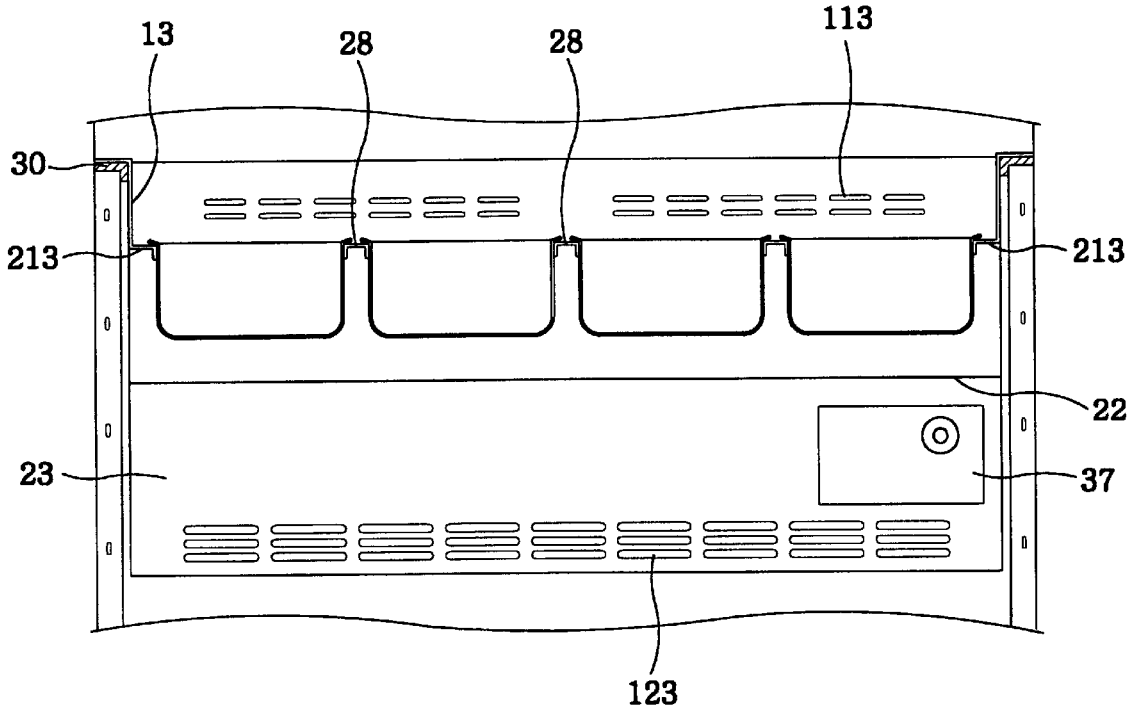
FIG. 3 describes a cross sectional view taken along the line 3—3 in FIG. 1.

Referring to FIG. 3, there is shown a partial cross sectional view taken along the line 3—3 in FIG. 1. The food preparation table 10 has a temperature controller 37 in the food storage compartment 15, which controls the operation of the compressor 52 and the pair of fans 33 to maintain a certain temperature set by a user. In addition, the preparation table 10 further includes three supporting rods 28, both ends of which are slidably rested on the ledge 213. The food container support 13 is insulated from the counter top 17 by an insulating material 30, e.g., urethane.

Figure 4:
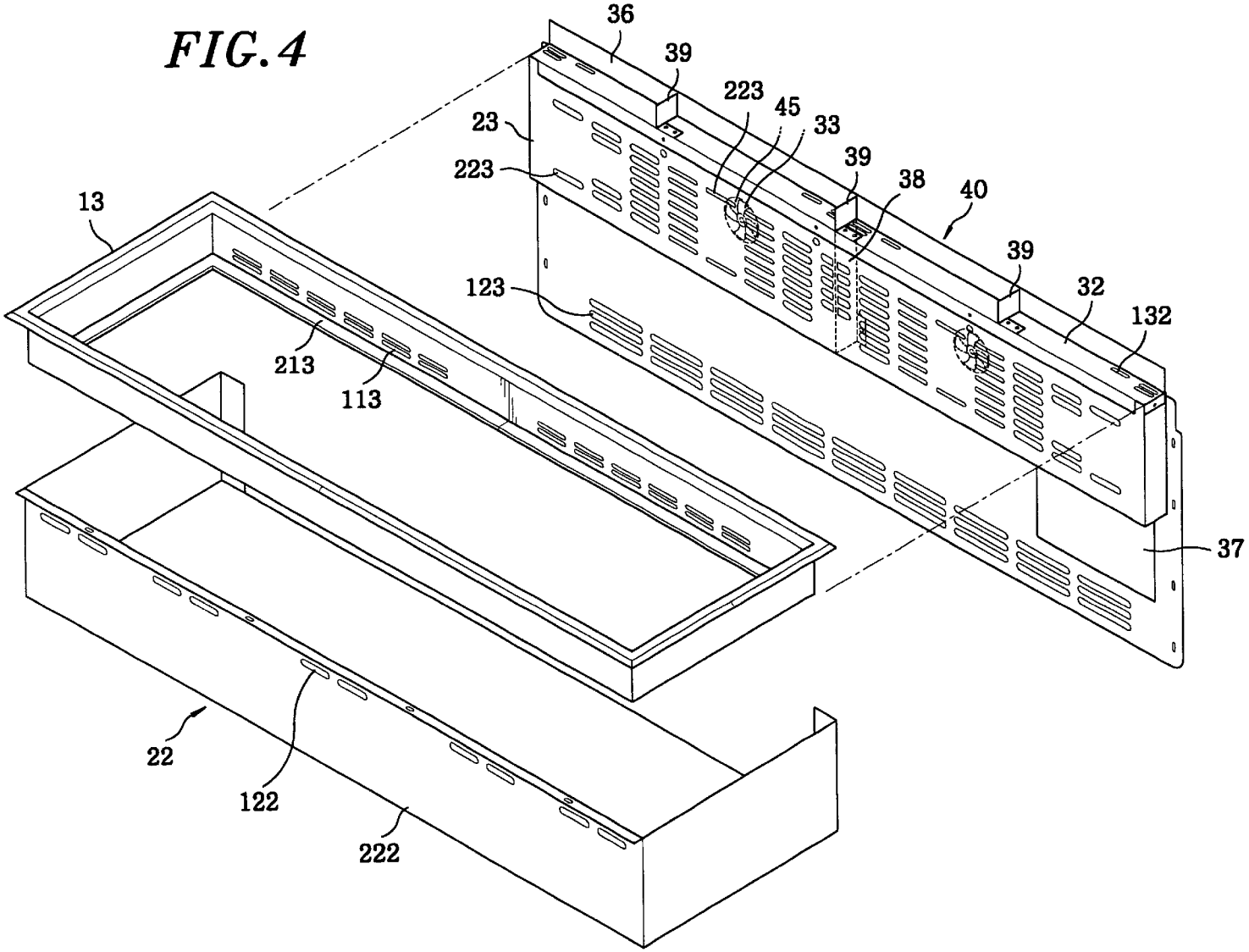
FIG. 4 offers a perspective exploded view of parts constituting the cooling system of the food preparation table in accordance with the preferred embodiment of the present invention.

Referring to FIG. 4, there is shown a perspective exploded view of parts constituting the cooling system of the food preparation table 10. The air distributing member 40 has a louver plate 23 with a plurality of intake openings 123 and distributing openings 223, a fan plate 36 attached to the back of the louver plate 23 and provided with a pair of fan openings 45, a top louver plate 32 disposed above the louver plate 23, and three dividing plates 39 affixed on the surface of the top louver plate 32 and dividing equally the air room 41 into four portions. The top louver plate 32 has a plurality of air room openings 132 formed at locations where a flow velocity of the circulating air in the air room 41 is very low. In this embodiment, the air room openings 132 are formed at corners of each portion divided by the dividing plates 39 far from the fans 33. The food container support 13 has two rows of stagnant air openings 113 on a longer side functioning as a side wall of the air room 41. The duct plate 22 has a plurality of duct openings 122 formed in a front wall 222.

Figure 5:
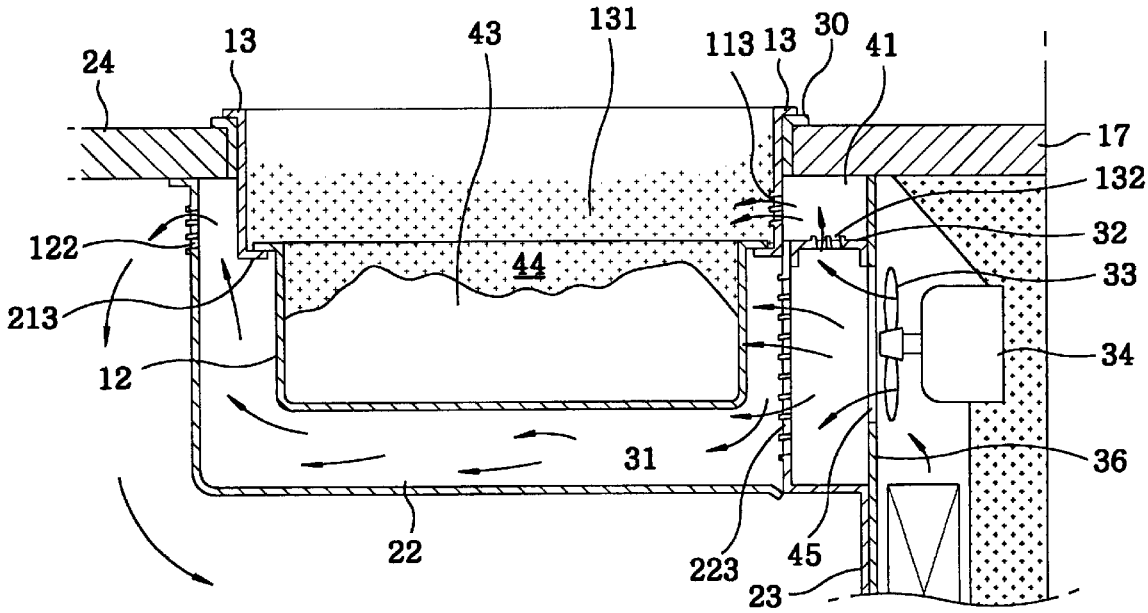
FIG. 5 provides a cross view of the food preparation table in accordance with the preferred embodiment of the present invention indicating the direction of air flows by the arrows.

The operation of the cooling system of the preferred embodiment will now be described with reference to FIGS. 5 and 6.

When a temperature sensor (not shown) detects an increase in the temperature of the foodstuffs 43 in the food containers 12, the temperature controller 37 starts to operate the compressor 52 and the motors 34. The circulating air around the evaporator 35 loses heat and flows to the fans 33. The fans 33 force the cooled circulating air to flow into an air distributing plenum 50 through the fan openings 45. Large portion of the circulating air in the air distributing plenum 50 flows into the cooling plenum 31 through the distributing openings 223. Small portion of the circulating air in the air distributing plenum 50 is pushed into the air room 41 through the air room openings 132 and then into the barrier plenum 131 through the stagnant air openings 113.

As shown in FIG. 4, the distributing openings 223 formed far from the fans 33 are large while the openings 223 formed near to the fans 33 are small, and there is no opening in front of the fans 33. Accordingly, the large portion of the circulating air flowing out of the air distributing plenum 50 is distributed evenly along the width of the food preparation table 10. The large portion of the circulating air travels around the food containers 12 absorbing heat from the food containers 12 and foodstuffs 43 so that the temperature of the foodstuffs 43 in the food containers 12 can be decreased.

Figure 6:
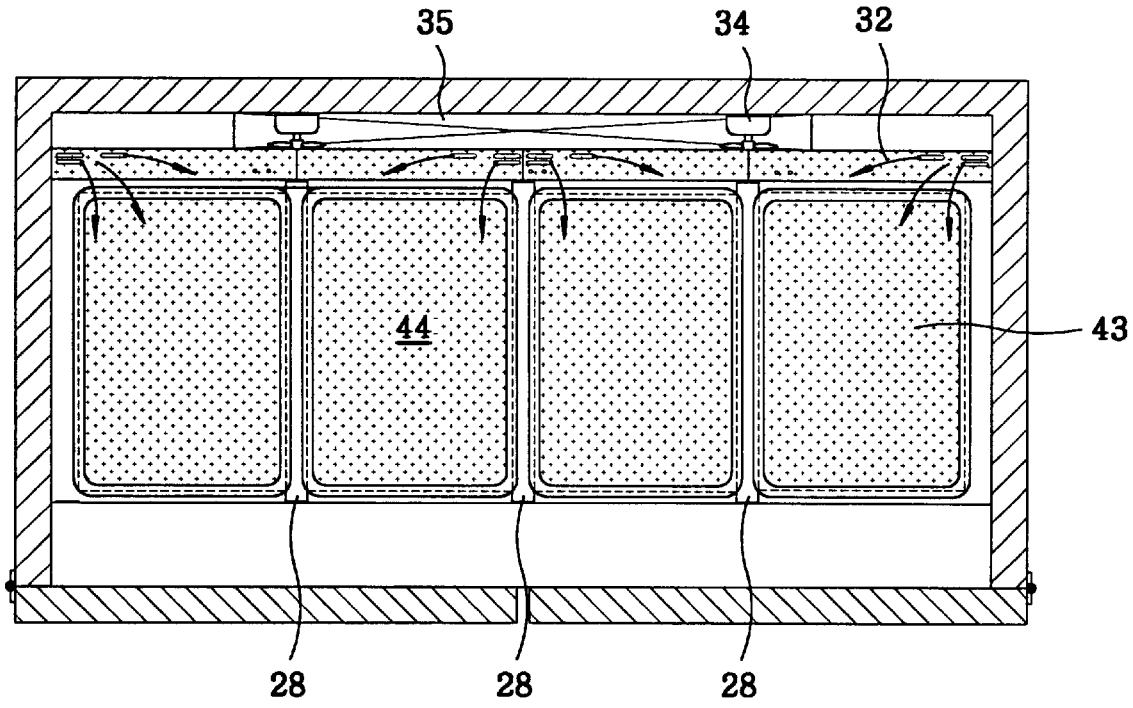
FIG. 6 provides a top view of the food preparation table in accordance with the preferred embodiment of the present invention indicating the direction of air flows by the arrows.

The small portion of the circulating air flowing out of the air room 41 through the stagnant air openings 113 has a very low velocity slightly greater than zero (0) and thus accumulated above the foodstuffs 43 in the food containers as shown in FIG. 6. The accumulated air 44 absorbs heat from the foodstuffs and forms an insulating barrier, which prevents the foodstuffs 43 from absorbing heat from an outer air having relatively high temperature.

Further, the food container support 13 is in contact with the air room 41, so its temperature can be lower than that of the accumulated air and absorbs heat from the accumulated air in the barrier plenum 131.

The large portion of the circulating air in the cooling plenum 31 flows into the food storage compartment 15 through the duct openings 122 and then to the evaporator 35 through the intake openings 123.

In the food preparation table 10 employing the inventive cooling system described above, since the accumulated air 44 forms the insulating barrier, the food preparation table 10 can prevent the outer air from being absorbed into the food storage compartment 15.

Further, since there is no need to provide the circulating air while the temperature of the accumulated air is maintained at a relatively low level compared with the ambient air, the fans 33 may operate intermittently, thereby making the food preparation table more efficient than conventional ones.

While the invention has been shown and described with respect to the preferred embodiments, it will be understood by those skilled in the art that various changes and modification may be made without departing from the spirit and scope of the invention as defined in the following.

What is claimed is:

1. A food preparation table for preparing food and refrigerating foodstuffs comprising:

at least one open top food container for holding foodstuffs;

a cooling device for absorbing heat from air;

an accelerating device for forcing the air to flow; and an air supplying device for making a first portion of the air flow around said at least one open top food container and a second portion of the air stacked above the foodstuffs contained in said at least one open top food container.

2. The food preparation table of claim 1, wherein the air supplying device includes:

an air room for supplying the second portion of the air to said at least one food container, the second portion of the air having a flow velocity slightly greater than zero; and an air distributing chamber for making the first portion of the air flow around said at least one open top food container and making the second portion of the air enter the air room through a plurality of openings, wherein the air room is constructed above the air distributing chamber.

3. The food preparation table of claim 2, wherein the openings are disposed in such positions that the second portion of the air has low flow velocity compared with that of the first portion of the air.

4. The food preparation table of claim 3, wherein the openings are disposed at corners of an upper wall of the air distributing chamber.

5. The food preparation table of claim 1, further comprising a food container support for holding said at least one open top food container and providing a barrier plenum above said at least one open top food container.

6. The food preparation table of claim 5, wherein the barrier plenum makes the second portion of the air stacked above the foodstuffs in said at least one food container.

7. The food preparation table of claim 1, further comprising a cooling plenum through which the first portion of the air flows around said at least one open top food container.

8. The food preparation of claim 1, further comprising one or more covers for insulating the air stacked above said at least one open top food container from ambient air.

* * * * *